US006592394B2

(12) United States Patent
Sawada et al.

(10) Patent No.: US 6,592,394 B2
(45) Date of Patent: Jul. 15, 2003

(54) TERMINAL MOUNTED INSULATOR PLATE

(75) Inventors: Yoshitsuga Sawada, Shizuoka (JP); Takuya Hasegawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/987,904

(22) Filed: Nov. 16, 2001

(65) Prior Publication Data

US 2002/0060088 A1 May 23, 2002

(30) Foreign Application Priority Data

Nov. 17, 2000 (JP) ..... 2000-351827

(51) Int. Cl.[7] ..... H01R 4/24
(52) U.S. Cl. ..... 439/404
(58) Field of Search ..... 439/397, 404, 439/405, 403, 402, 395

(56) References Cited

U.S. PATENT DOCUMENTS 5,120,235 A * 6/1992 Kashiwa ..... 439/405
5,791,933 A * 8/1998 Saka et al. ..... 439/404
5,820,404 A * 10/1998 Chishima et al. ..... 439/417
5,954,533 A * 9/1999 Hatagishi et al. ..... 439/397
6,062,896 A * 5/2000 Huang ..... 439/405
6,383,038 B2 * 5/2002 Murakami et al. ..... 439/854
6,447,325 B1 * 9/2002 Yamane et al. ..... 439/404

* cited by examiner

*Primary Examiner*—Lynn D. Feild
*Assistant Examiner*—Thanh-Tam Le
(74) *Attorney, Agent, or Firm*—Armstrong, Westerman & Hattori LLP

(57) ABSTRACT

A press-fit terminal mounting plate is an insulator plate mounted with a plurality of press-fit terminals for an electrical junction box. The press-fit terminal has a cable connection part and an electrical contact part. The terminal mounting plate has a bottom wall, a plurality of partition walls, a plurality of electrical cable receiving channels, and an accommodation space. The partition walls are raised from the bottom wall, and the partition walls are parallel to each other. The electrical cable receiving channel consists of a pair of the partition walls and the bottom wall. The electrical cable receiving channel receives the press-fit terminals and a portion of an electrical cable. A plurality of accommodation spaces are provided adjacent to the electrical cable receiving channel for receiving the electrical contact parts of the press-fit terminals. The accommodation space can have a side opening formed in the partition wall located in either side of the accommodation space. Thus, the accommodation space can selectively receive the electrical contact part of the press-fit terminal related to the electrical cable receiving channel located in each adjacent side of the accommodation space.

8 Claims, 6 Drawing Sheets

TERMINAL MOUNTED INSULATOR PLATE

BACKGROUND OF THE INVENTION

1. Field of the Invention

The present invention relates to an insulator plate mounted with a plurality of press-fit terminals.

2. Related Art

A wiring harness arranged in a motor vehicle is obtained by assembling a plurality of sub-harnesses each having a specific function for electronic equipment. Thus, it is a complicated work to connect electrical cables across different sub-harnesses, decreasing an assembling workability of the wiring harness to possibly cause an unstable quality of the wiring harness.

The applicants of the present invention have proposed a plate-type connector consisting of a plurality of layered insulator plates 160 for an easy electrical connection across electrical cables provided in different sub-harnesses. As illustrated in FIG. 8, each insulator plate 160 is mounted with a plurality of press-fit terminals 150.

The insulator plate 160 has a bottom wall 163*a* of a flat plate and plural pairs of partition walls 163*c* raised from the bottom wall 163*a*. The partition walls 163*c* are parallel to each other. Between each pair of partition walls 163*c*, there is defined an electrical cable receiving channel 161. In one of each pair of the partition walls 163*c*, there are longitudinally provided a plurality of side openings to partially define a plurality of recesses 171 outside the one partition wall 163*c*. The recesses 171 are aligned in a direction parallel to the electrical cable receiving channel 161.

The press-fit terminal 150 is formed by bending an electrically conductive metal plate. The press-fit terminal 150 has a cable connection part 151 of a channel shape and an electrical contact part 152 contiguous with the cable connection part 151. The cable connection part 151 press-fits an electrical cable therein. The electrical contact part 152 is inserted by a connection bar of an electrical conductive metal plate.

The cable connection part 151 and electrical contact part 152 define the press-fit terminal 150 in an L-shape with respect to a plan view thereof. The press-fit terminal 150 is disposed on the bottom wall 163*a* of the insulator plate 160. The electrical contact part 152 is received in the recess 171, and the cable connection part 151 is received in the electrical cable receiving channel 161.

On the bottom wall 163*a* of the insulator plate 160, plural rows of the press-fit terminals 150 are arranged such that each row is oriented in a longitudinal direction of each electrical cable receiving channel 161. That is, the insulator plate 160 is mounted with the press-fit terminals 150 in a two-dimension matrix pattern on the bottom wall 163*a* thereof. A plurality of such insulator plates 160 each provided with such press-fit terminals 150 are layered one another. Then, electrical conductive connection bars are inserted into the electrical contact parts 152 to connect predetermined electrical contact parts 152 across different insulator plates 160 to complete the plate-type connector.

Thus configured plate-type connector is received in an electrical junction box in a movable body like a motor vehicle. The connector electrically connects various kinds of electronic devices to a power source or other electrical equipment in the vehicle according to a predetermined pattern.

The insulator plate 160 illustrated in FIG. 8 is provided with the press-fit terminals 150, which achieves an easy electrical connection across different sub-harnesses. Because, the electrical cables extend in directions different from insertion directions of the connections bars into the electrical contact parts 152. For the purpose, the press-fit terminal 150 has the cable connection part 151 and the electrical contact part 152 in an L-shape.

However, the press-fit terminals 150 arranged on the bottom wall 163*a* causes a dead space shown by a shadow line area R in FIG. 8. The area R is used neither for the press-fit terminals 150 nor the electrical cables. The dead space R is positioned between the electrical cable receiving channels 161 and between the recesses 171. The dead space R increases the insulator plate 160 in size, so that the insulator plate obtained by layering a plurality of the plate-type connector 160 also increases in size.

SUMMARY OF THE INVENTION

Therefore, an object of the present invention is to provide an insulator plate which allows a size reduction thereof with a matrix pattern of press-fit terminals.

For achieving the object, a terminal mounted insulator plate according to the present invention is an insulator plate for mounting a plurality of press-fit terminals each having an electrical cable connection part and an electrical contact part contiguous with the cable connection part, wherein the insulator plate includes:

- a bottom wall on which the press-fit terminal is disposed,
- a plurality of partition walls raised from the bottom wall parallel to each other,
- an electrical cable receiving channel defined between adjacent two of the partition walls for receiving the cable connection part of the press-fit terminal and an electrical cable connected to the cable connection part, and
- an accommodation space positioned adjacent to the electrical cable receiving channel for receiving the electrical contact part of the press-fit terminal, the accommodation space being a recess having a side opening formed in one of the adjacent partition walls.

Thus, the recess receiving the electrical contact part can have the opening in either of the partition walls adjacent to the electrical contact part. Thereby, the recess can selectively receive the electrical contact part which is associated with either of electrical cable receiving channels located each side of the recess.

Thereby, a dead space in the terminal mounting plate is reduced, allowing a size reduction of the terminal mounting plate.

Preferably, the insulator plate has a plurality of the accommodation spaces located between adjacent two of the partition walls, wherein the openings of the recesses are alternately provided in one and the other of the adjacent partition walls.

Thus, the press-fit terminals can be oriented such that a pair of adjacent terminals are symmetrically positioned in respect of a longitudinal row of the terminals. Thereby, a dead space in the terminal mounting plate to mount the press-fit terminals thereon is reduced, allowing a size reduction of the terminal mounting plate.

Preferably, the insulator plate has a pair of support walls each contiguous with at least one of the adjacent partition walls, the pair of the support walls opposed to each other for positioning of the electrical contact part received in the accommodation space.

Thus, the electrical contact is positioned between the pair of support walls contiguous with the partition walls.

Thereby, the support walls prevent an undesirable deformation of the partition walls defining the electrical cable receiving channels near the accommodation space. In addition, the support walls prevent an outward deformation of the cable connection part of the press-fit terminal. Thereby, a reliable electrical connection is achieved between the cable connection part of the press-fit terminal and the electrical cable.

Preferably, the electrical contact part of the press-fit terminal has an outwardly projected locking lance, and one of the opposed support walls has a locking protrusion engageable with the locking lance.

Thereby, a reliable electrical connection is achieved between the cable connection part of the press-fit terminal and the electrical cable. Furthermore, the press-fit terminal is surely secured to the mounting plate.

Preferably, the cable connection part and the electrical contact part of the press-fit terminal define an L-shape. A plurality of the insulator plates may be layered one another. The electrical contact part of the press-fit terminal can receive a connection bar that is positioned vertical to the bottom plate, and the connection bar can electrically connect a plurality of the press-fit terminals mounted on different ones of the insulator plates. The insulator plate may be a plate molded to define unitarily the bottom plate, the cable connection channel, and the accommodation space.

DETAILED DESCRIPTION OF PREFERRED EMBODIMENT

Figure 1:
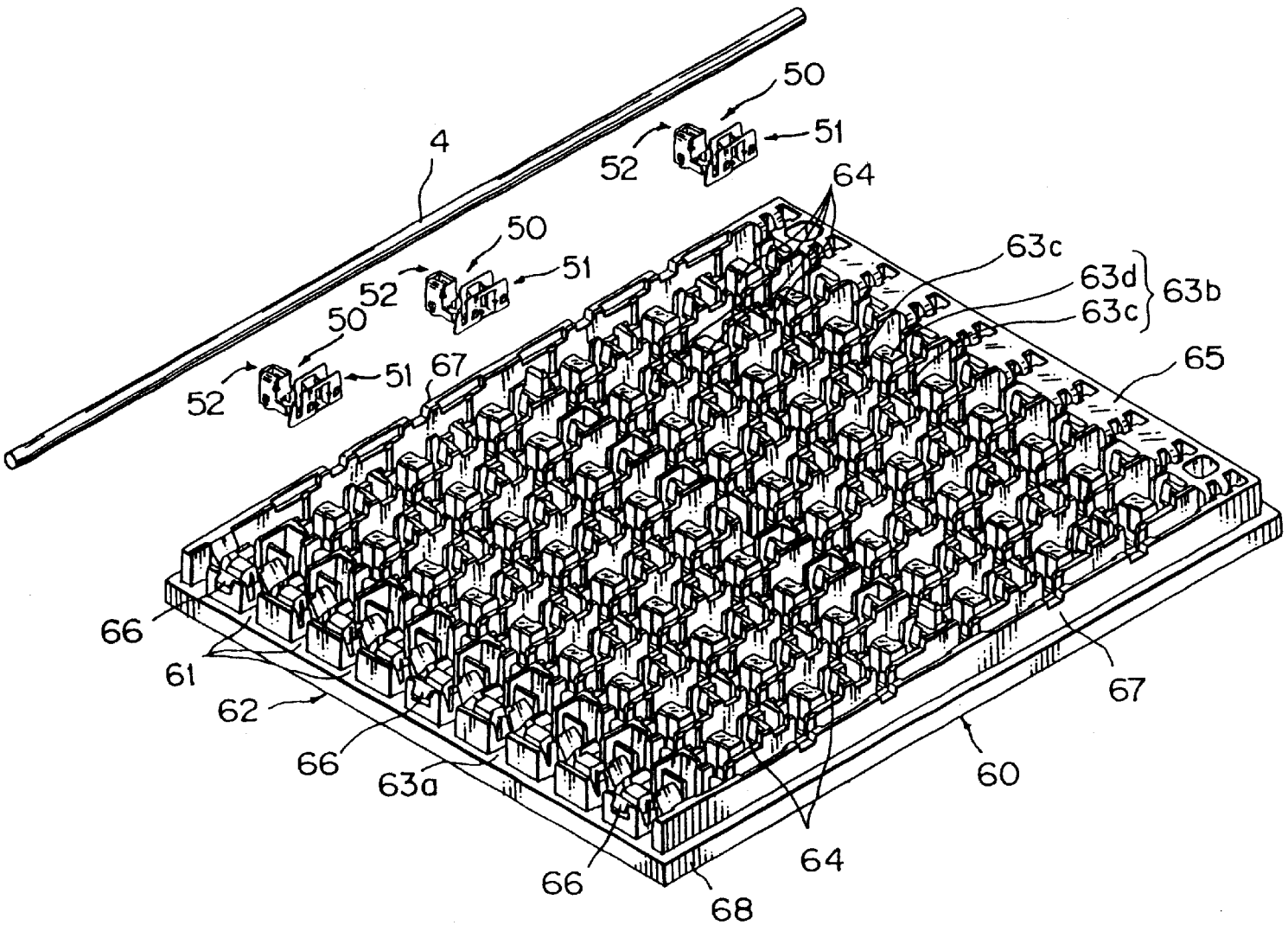
FIG. 1 is a perspective view mainly showing a press-fit terminal mounting plate of an embodiment of the present invention.
Figure 2:
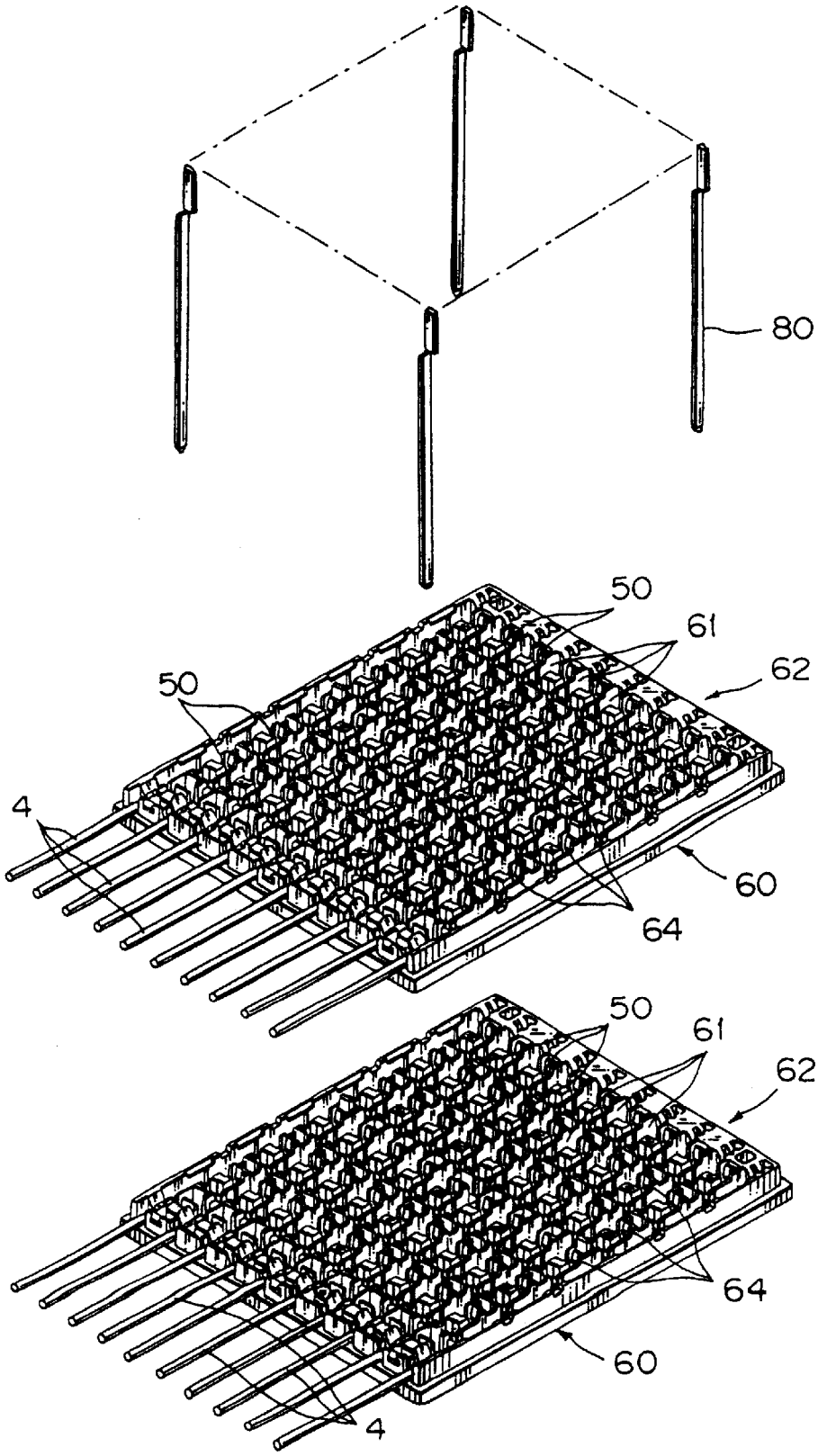
FIG. 2 is a perspective view showing two of the press-fit terminal mounting plates of FIG. 1 which are aligned with each other before layering thereof.

Referring to FIGS. 1 to 7, a press-fit terminal mounting plate 60 of an embodiment of the present invention will be discussed in detail. The terminal mounting plate 60 shown in FIG. 1 is mounted with press-fit terminals 50 shown in FIG. 4 to compose an electrical junction box (or a junction block). A plurality of the terminal mounting plates 60, as illustrated in FIG. 2, are layered to define a multi-layered plate connector 1 shown in FIG. 3.

The press-fit terminal 50 receives an electrical cable 4 illustrated in FIG. 1. The multi-layered plate connector 1 electrically connects the electrical cables 4 attached to the press-fit terminals according to a predetermined pattern.

Figure 4:
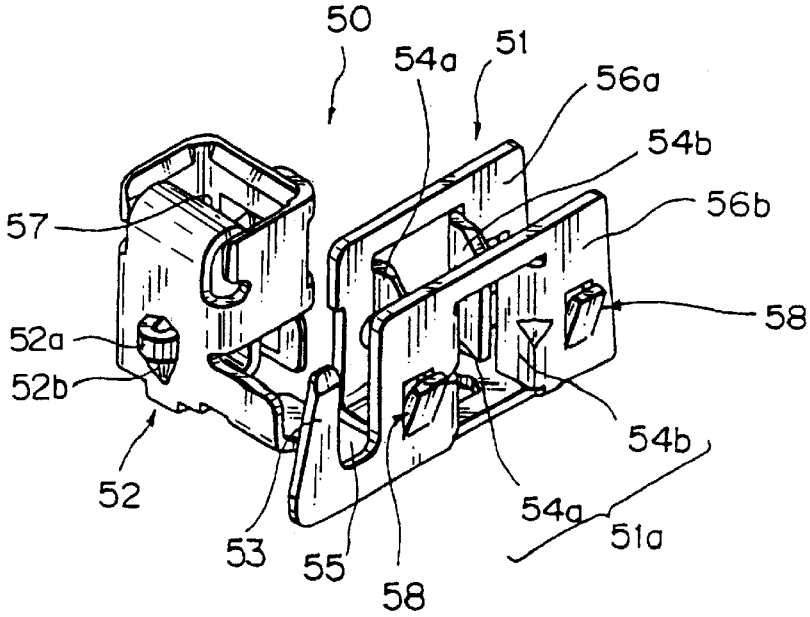
FIG. 4 is a perspective view showing a press-fit terminal applied to the multi-layered plate connector of FIG. 3.
Figure 5:
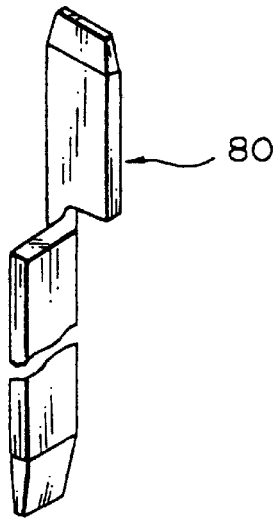
FIG. 5 is a perspective view showing a connection bar used in the multi-layered plate connector of FIG. 3.

The press-fit terminal 50 is formed from an electrical conductive metal plate with a bending step thereof. The press-fit terminal 50, as illustrated in FIG. 4, has a cable connection part 51 for the electrical cable 4, an electrical contact part 52, and a plurality of locking lances 58. The cable connection part 51 has a flat base wall 55 retaining the electrical cable 4, a pair of side walls 56*a*, 56*b*, a crimping piece 53, and a press-fit part 51*a*.

The base wall 55 and the side walls 56*a*, 56*b* each are defined in a plate bar. The pair of side walls 56*a*, 56*b* each are raised from a side edge of the base wall 55 to be spaced from each other. Between the pair of side walls 56*a*, 56*b*, the electrical cable 4 is introduced to be attached to the press-fit part 51*a*.

The crimping piece 53 is raised from an side edge of the base wall 55. The crimping piece 53 secures the electrical cable 4 to the base wall 55 by bending the piece 53 toward the base wall 55 to crimp the electrical cable 4.

The press-fit part 51*a* has two pairs of opposed press-fit blades 54*a*, 54*b* standing on the base wall 55. The press-fit blade 54*a*, 54*b* are inwardly projected from the side walls 56*a*, 56*b* to come close to each other.

The press-fit blades 54*a*, 54*b* receive the electrical cable 4 therebetween to cut a sheath of the electrical cable 4, so that the blades 54*a*, 54*b* electrically contact a core wire of the electrical cable 4. That is, the electrical cable 4 is fitted to the press-fit blades 54*a*, 54*b*.

The electrical contact part 52 is contiguous with a side edge of the base wall 55, so that the electrical contact part 52 is contiguous with the cable connection part 51. The electrical contact part 52 and the cable connection part 51 are defined in an L-shape in a plan view of the press-fit terminal 50. The electrical contact part 52 is positioned so as to turn relative to a longitudinal direction of the cable connection part 51 for the electrical cable 4 retained on the base wall 55.

The electrical contact part 52 is a substantially square pipe column. The electrical contact part 52 has a terminal locking lance 52*a* projecting outward. The lance 52*a* is provided in the pipe column near the base wall 55.

Figure 7:
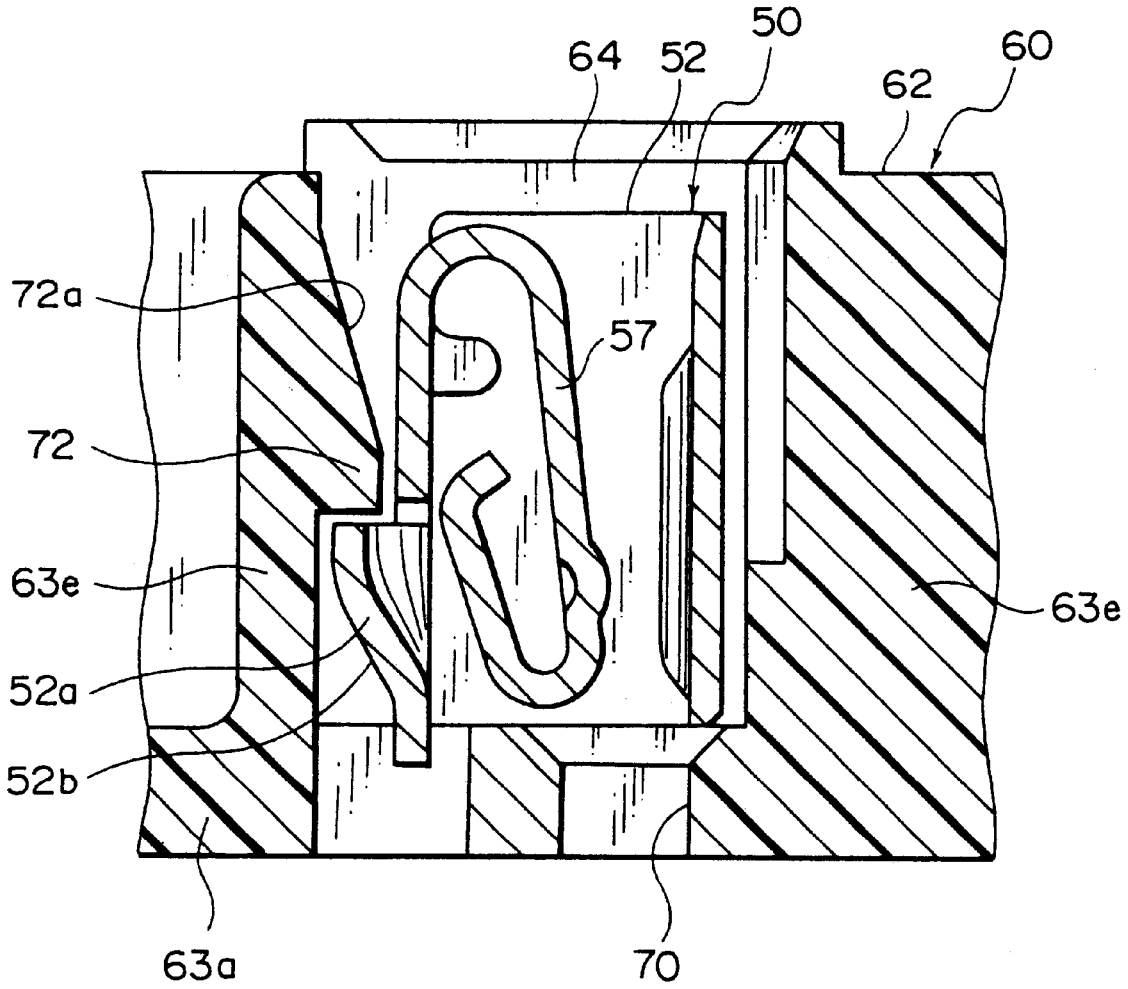
FIG. 7 is a sectional view taken along line VII—VII of FIG. 6.
Figure 8:
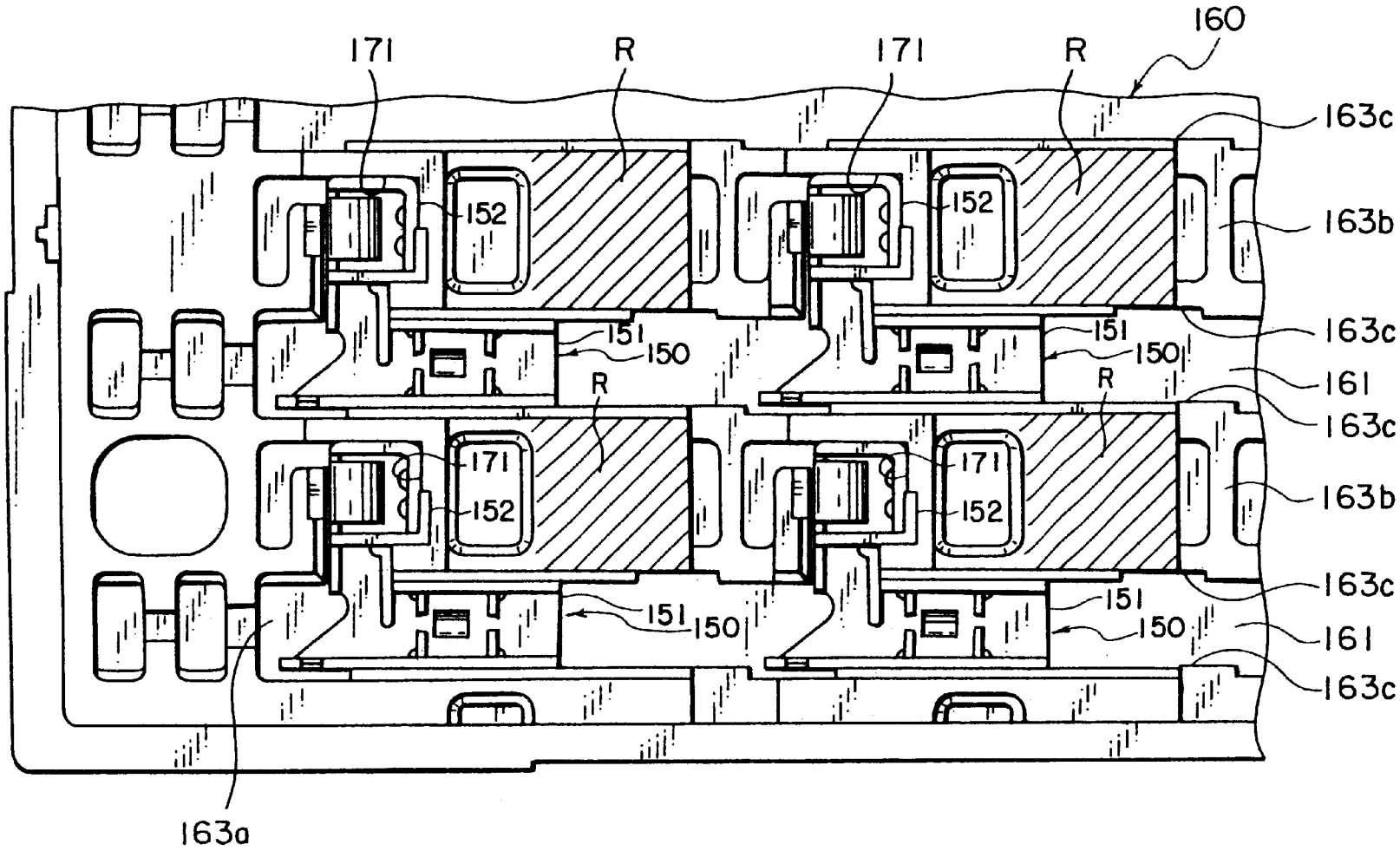
FIG. 8 RELATED ART
FIG. 8 is a plan view showing a related-art insulator plate mounted with press-fit terminals.

The terminal lance 52*a*, as illustrated in FIGS. 4 and 7, has an inclined surface 52*b* to gradually come close to a general outer surface of the electrical contact part 52 toward the base wall 55. The lance 52*a* is resiliently deflectable perpendicular to the general outer surface of the electrical contact part 52.

The pipe column of the electrical contact part 52 is positioned to align with a connection hole 70 of the press-fit terminal mounting plate 60. The pipe column of the electrical contact part 52 is inserted by a connection bar 80 shown in FIG. 5.

The connection bar 80 is made of an electrical conductive metal. Within the pipe column of the electrical contact part 52, there is provided a resilient contact piece 57. The resilient contact piece 57 presses the connection bar 80 against an inner wall surface of the pipe column of the electrical contact part 52. Thus, the resilient contact piece 57 electrically connects the connection bar 80 to the electrical contact part 52.

The insertion of the connection bar 80 into the electrical contact parts 52 of the press-fit terminals 50 of the terminal mounting plates 60 layered one another can electrically connect the press-fit terminals 50 disposed on the different terminal mounting plates 60 to each other.

Another locking lance 58 is provided on each of the side walls 56*a*, 56*b* by partially cutting and raising the side walls. Each locking lance 58 is raised from each side wall 56*a* or 56*b* to have a free end projecting outward.

Each locking lance 58, as illustrated in FIG. 4, is inclined toward the free end so as to be gradually apart from each side wall 56*a* or 56*b*. The locking lance 58 is engageable with an inner wall 63*c* of a partition wall 63*b* when the press-fit terminal 50 is received in the terminal mounting plate 60.

The cable connection part 51 of the press-fit terminal 50 is received in an electrical cable receiving channel 61 of the press-fit terminal mounting plate 60, while the electrical contact part 52 is received in an accommodation space 64. The press-fit terminal 50 is pushed into the electrical cable receiving channel 61 and the accommodation space 64 with the locking lance 58 being pressed. Thereby, the terminal 50 is received in the channel 61 and the accommodation space 64 of the terminal mounting plate 60 to be retained therein.

The terminal mounting plate 60 is a flat plate made of an electrically insulating synthetic resin material. The terminal mounting plate 60, as illustrated in FIGS. 1 to 3 and FIG. 6, has a rectangular plate main body 62, a plurality of the electrical cable receiving channels 61, the accommodation spaces 64, and the connection holes 70 (see FIG. 6). The plate main body 62 has a generally flat bottom wall 63*a*, an end wall 65, a pair of side walls 67, a plurality of partition walls 63*b* raised from the bottom wall 63*a*, and a peripheral flange portion 68.

The end wall 65 is contiguous with an edge of the bottom wall 63*a* at a back side of the bottom wall 63*a* as shown in FIG. 1. The end wall 65 is raised from the bottom wall 63*a*. Each side walls 67 is contiguous with each lateral edge of the end wall 65. The pair of side walls 67 are raised from the bottom wall 63*a* and are parallel to each other.

The partition walls 63*b* are parallel spaced from each other. The partition walls 63*b* are also parallel to the pair of side walls 67. Each partition wall 63*b* extends along a longitudinal direction of the plate main body 62 and has an inner wall 63*c* and a lateral wall 63*d*.

The inner walls 63*c* are parallel to each other and are raised from the bottom wall 63*a*. The inner walls 63*c* are spaced from each other parallel to the side walls 67.

The flange portion 68 is provide to surround the bottom wall 63*a* to increase a rigidity of the plate main body 62 to prevent a deformation of the bottom wall 63*a*, that is, of the plate main body 62.

The electrical cable receiving channel 61 is defined by two of adjacent partition walls 63*b* and the bottom wall 63*a*. A plurality of the electrical cable receiving channels 61 are parallel provided each in a longitudinal direction of the plate main body 62, that is, parallel to the side walls 67.

The electrical cable receiving channel 61 receives a portion of the electrical cable 4 and the cable connection parts 51 of the press-fit terminals 50.

The accommodation space 64 is a recess having opening formed in the inner wall 63*c* to open to the electrical cable receiving channel 61. The accommodation space 64 is located between adjacent two of the electrical cable receiving channels 61. A plurality of the accommodation spaces 64 are provided to have the openings alternately toward one of the adjacent electrical cable receiving channel and toward the other parallel to a longitudinal direction of the electrical cable receiving channels 61.

The accommodation space 64 receives the electrical contact part 52 of the press-fit terminal 50. Each connection hole 70 corresponds to one of the accommodation space 64. The connection hole 70 passes through the bottom wall 63*a* of the plate main body 62.

The press-fit terminal mounting plate 60 has also a plurality of voids 71. The void 71 is adjacent to the accommodation spaces 64 of the electrical contact parts of the press-fit terminals 50.

That is, the voids 71 are defined laterally between the electrical cable receiving channels 61. Longitudinally between the voids 71, there is provided the accommodation space 64 receiving the electrical contact part 52 of the press-fit terminal 50.

On the inner wall 63*c* of the press-fit terminal mounting plate 60, there are provided a plurality of lateral support walls 63*e* fitted thereto. The support walls 63*e* are spaced from each other in a longitudinal direction of the press-fit terminal mounting plate 60. Longitudinally between a pair of the support walls 63*e*, the accommodation space 64 is located.

The pair of support walls 63*e* define partially the accommodation space 64 to receive the electrical contact part 52.

One of the pair of support walls 63*e* partially defining the accommodation space 64 has a lance locking protrusion 72 illustrated in FIG. 7. The locking protrusion 72 is a hook protruding from the one of the support walls 63*e* toward the accommodation space 64. The locking protrusion 72 is located an end portion of the support wall 63*e* apart from the bottom wall 61*a*.

The locking protrusion 72 has a second inclined surface 72*a* extended from the end portion of the support wall 63*e* toward the bottom wall 63*a* with an inward angle relative to the accommodation space 64. The second inclined surface 72*a* slidingly contacts the inclined surface 52*b* when the electrical contact part 52 of the press-fit terminal 50 is pushed into the accommodation space 64. The locking protrusion 72 engages with the terminal lance 52*a*.

The press-fit terminal mounting plate 60 has a plurality of lock projections 66 and a plurality of hooking projections. Each lock projection 66 engages with one of the hooking projections. In assembling of the multi-layered plate connector 1, the engagement of the lock projection 66 with the hooking projection secures the terminal mounting plates 60 to one another.

Figure 6:
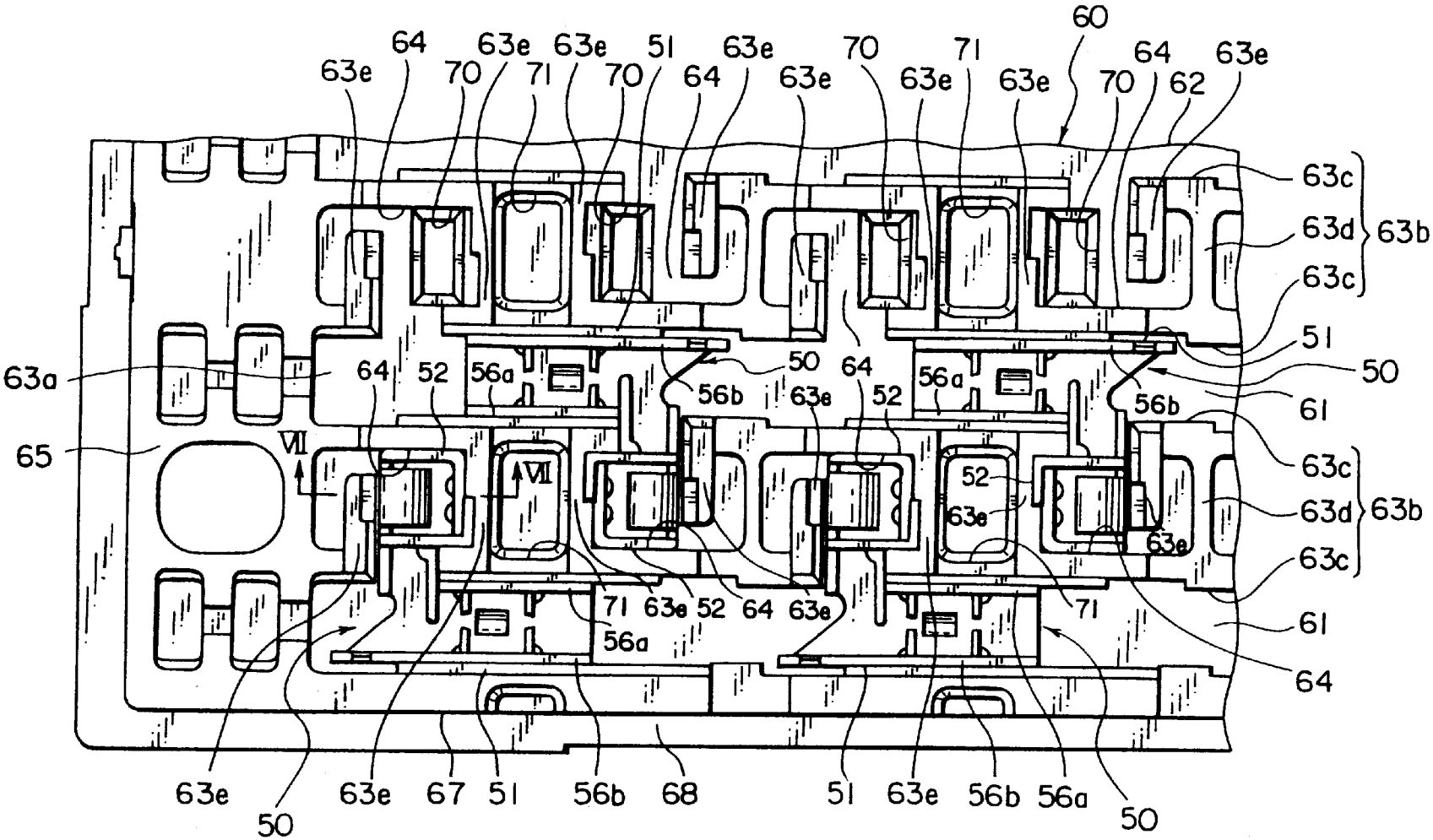
FIG. 6 is a plan view showing the press-fit terminal mounting plate mounted with a plurality of the press-fit terminals of FIG. 4.

In the press-fit terminal mounting plate 60, as illustrated in FIG. 6, the press-fit terminals 50 are arranged on the bottom wall 63*a* along a longitudinal direction of the electrical cable receiving channel 61 and along a direction perpendicular to the longitudinal direction. That is, the press-fit terminal mounting plate 60 has the press-fit terminals 50 disposed on the bottom wall 63*a* in a two-dimensional matrix pattern.

For assembling the multi-layered plate connector 1, first, the press-fit terminal mounting plate 60 receives the press-fit terminals 50. Thereby, the cable connection part 51 is received in the electrical cable the accommodation space 61, and the electrical contact part 52 is received in the accommodation space 64. At the mounting operation of the terminals, when each press-fit terminal 50 comes close to the bottom wall 63*a*, the inclined surface 52*b* of the terminal lance 52*a* contacts the second inclined surface 72*a* of the locking protrusion 72.

By the inclined surface 52*b* and the second the inclined surface 72*a*, the terminal lance 52*a* resiliently deflects inward within the electrical contact part 52, and the locking protrusion 72 resiliently deflects outward in the accommodation space 64. Furthermore, against resilient reaction forces of the terminal lance 52*a* and the locking protrusion 72, the press-fit terminal 50 is inserted into the electrical cable receiving channel 61 and the accommodation space 64. Thereby, the terminal lance 52*a* engages with the locking protrusion 72 at a side of the bottom wall 63*a*, so that the press-fit terminal 50 rests on the bottom wall 63*a*.

The terminal lance 52*a* and the locking protrusion 72 return to their original positions (free positions) with the resilient reaction forces thereof, so that they engage with each other. Thus, the press-fit terminal 50 is secured to the plate main body 62. Moreover, when the press-fit terminal 50 is mounted in the plate main body 62, the locking lance 58 engages with the inner wall 63*c* of the partition wall 63*b*. Accordingly, the press-fit terminal 50 is reliably secured to the terminal mounting plate 60.

Then, the electrical cable 4 is fitted to the press-fit terminal 50. The electrical cable 4 is pressed between the press-fit blades 54*a*, 54*b* in the electrical cable receiving channel 61. Thereby, between the side walls 56*a*, 56*b*, the press-fit blades 54*a*, 54*b* cut a sheath 5 of the electrical cable 4 to contact a core wire 6. Accordingly, the press-fit blades 54*a*, 54*b* of the cable connection part 51 electrically connect to the electrical cable 4.

Figure 3:
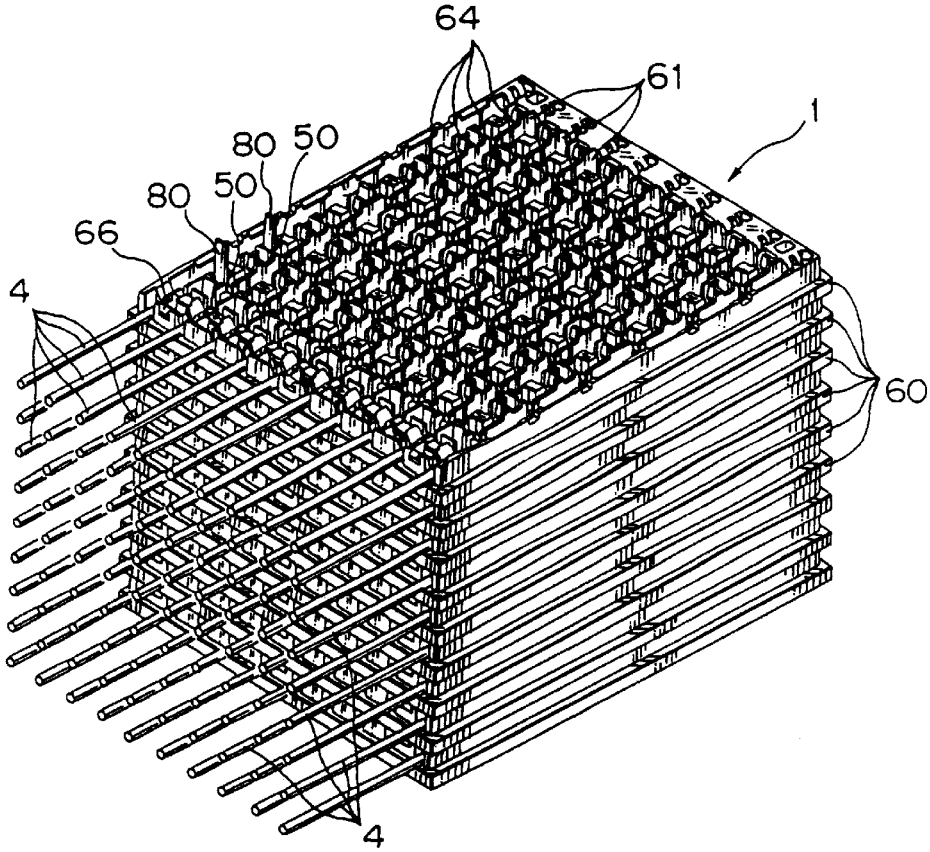
FIG. 3 is a perspective view showing a multi-layered plate connector obtained by layering the press-fit terminal mounting plates of FIG. 1.

In this state, the plate main bodies 62 of the terminal mounting plates 60, as illustrated in FIG. 2, are parallel aligned with each other with spaces therebetween. Then, the press-fit terminal mounting plates 60 come close to each other, and the lock projections 66 engage with the hooking projections to secure the plates to each other. The terminal mounting plates 60 are inserted by the connection bars 80 through predetermined connection holes 70 and electrical contact parts 52. Thereby, as illustrated in FIG. 3, the multi-layered plate connector 1 is completed.

The multi-layered plate connector 1 selectively arranges the press-fit terminals 50 on the bottom walls 63 and selectively locates the connection bars 80. Thereby, the electrical cables 4 fitted to the press-fit terminals 50 are electrically connected in a predetermined connection pattern. The multi-layered plate connector 1 may be received in an electrical junction box having relays and fuses which will be connected to the electrical cables 4 in a predetermined connection pattern.

In the embodiment, the accommodation space 64 for the electrical contact part 52 can have a side opening formed in the inner wall 63*c* located in either side of the accommodation space 6. Thus, as illustrated in FIG. 6, the accommodation space 64 can selectively receive the electrical contact part 52 of the press-fit terminal related to the electrical cable receiving channel 61 located in each adjacent side of the accommodation space 6.

The accommodation spaces 64 are arranged to have the side opening alternatively in the two adjacent inner walls 63*c*. Thus, the press-fit terminals 50 can be oriented such that a pair of adjacent terminals are symmetrically positioned in respect of a longitudinal row of the terminals.

Thus, a dead space in the terminal mounting plate 60 to mount the press-fit terminals 50 thereon is reduced, allowing a size reduction of the terminal mounting plate 60.

The inner walls 63*c* of the partition wall 63*b* are provided with a plurality of the support walls 63*e*. These support walls 63*e* are extended respectively perpendicular to a longitudinal direction of the electrical cable receiving channels 61. A pair of support walls 63*e* are provided for each accommodation space 64 to position the electrical contact part 52 therebetween.

The support walls 63*e* also prevent an outward deformation of the inner walls 63*c* defining the electrical cable receiving channel 61 particularly near the accommodation space 64.

Moreover, the support walls 63*e* prevent an outward deformation of the side walls 56*a*, 56*b* of the press-fit terminal 50 received in the electrical cable receiving channel 61. Thus, the support walls 63*e* serve to prevent the press-fit blades 54*a*, 54*b* from moving apart from the core wire of the electrical cable 4. Thereby, a reliable electrical connection is achieved between the cable connection part 51 of the press-fit terminal 50 and the electrical cable 4.

One of the pair of support walls 63*e* has the locking protrusion 72 engageable with the terminal lance 52*a* of the press-fit terminal 50. Thus, the press-fit terminal 50 is surely secured to the press-fit terminal mounting plate 60.

What is claimed is:

1. A terminal mounted insulator plate for mounting a plurality of press-fit terminals each having an electrical cable connection part and an electrical part contiguous with the cable connection part, wherein the insulator plate comprises:

a bottom wall on which the press-fit terminal is disposed, a plurality of partition walls raised from the bottom wall parallel to each other, an electrical cable receiving channel defined between adjacent two of the partition walls for receiving a cable connection part of a press-fit terminal of the plurality of press-fit terminals and an electrical cable connected to the cable connection part, and an accommodation space positioned adjacent to the electrical cable receiving channel for receiving the electrical contact part of the press-fit terminal, the accommodation space being a recess having a side opening formed in one of the adjacent partition walls and said side opening alternated between adjacent partition walls, wherein the plurality of press-fit terminals are oriented for that a pair of adjacent press-fit terminals are symmetrically positioned in a longitudinal row.

2. The insulator plate as claimed in claim 1 comprising a plurality of the accommodation spaces located between adjacent two of the partition walls, wherein the side openings of the plurality of accommodation spaces are alternately provided in one and the other of the adjacent partition walls.

3. The insulator plate as claimed in claim 1 comprising a pair of the support walls each contiguous with at least one of the adjacent partition walls, the pair of the support walls opposed to each other for positioning of the electrical contact part received in the accommodation space.

4. The insulator plate as claimed in claim 3 wherein the electrical contact part of the press-fit terminal has an outwardly projected locking lance, and one of the opposed support walls has a locking protrusion engageable with the locking lance.

5. The insulator plate as claimed in claim 1 wherein the cable connection part and the electrical contact part of the press-fit terminal define an L-shape.

6. The insulator plate as claimed in claim 1 wherein a plurality of the insulator plates can be layered one another.

7. The insulator plate as claimed in claim 6 wherein the electrical contact part of the press-fit terminal can receive a connection bar that is positioned vertical to the bottom plate, and the connection bar can electrically connect a plurality of the press-fit terminals mounted on different ones of the insulator plates.

8. The insulator plate as claimed in claim 1 wherein the insulator plate is a plate molded to define unitarily the bottom plate, the cable connection channel, and the accommodation space.

* * * * *

UNITED STATES PATENT AND TRADEMARK OFFICE

CERTIFICATE OF CORRECTION

PATENT NO. : 6,592,394 B2
DATED : July 15, 2003
INVENTOR(S) : Sawada et al.

It is certified that error appears in the above-identified patent and that said Letters Patent is hereby corrected as shown below:

Title page,
Item [75], change "Yoshitsuga Sawada" to -- Yoshitsugu Sawada --

Signed and Sealed this

Sixteenth Day of December, 2003

JAMES E. ROGAN
*Director of the United States Patent and Trademark Office*